US007143919B2

(12) United States Patent
Weibel et al.

(10) Patent No.: US 7,143,919 B2
(45) Date of Patent: Dec. 5, 2006

(54) MAGAZINE WITH FASTENING ELEMENTS FOR A SETTING TOOL AND A SETTING TOOL WITH THE MAGAZINE WITH FASTENING ELEMENTS

(75) Inventors: Michael Weibel, Wil (CH); Stefan Bönig, Achberg-Esseratsweiler (DE)

(73) Assignee: Hilti Aktiengesellschaft, Schaan (LI)

( * ) Notice: Subject to any disclaimer, the term of this patent is extended or adjusted under 35 U.S.C. 154(b) by 28 days.

(21) Appl. No.: 11/070,429

(22) Filed: Mar. 2, 2005

(65) Prior Publication Data

US 2005/0194418 A1 Sep. 8, 2005

(30) Foreign Application Priority Data

Mar. 3, 2004 (DE) ..... 10 2004 010 320

(51) Int. Cl.
*B25C 1/14* (2006.01)

(52) U.S. Cl. ..... 227/10; 227/120; 227/127; 227/136

(58) Field of Classification Search ..... 227/10, 227/9, 127, 120, 136, 119
See application file for complete search history.

(56) References Cited

U.S. PATENT DOCUMENTS 3,670,942 A * 6/1972 Pomeroy ..... 227/10
3,891,133 A * 6/1975 Maier et al. ..... 227/10
4,051,990 A * 10/1977 Chromy et al. ..... 227/10
4,201,324 A * 5/1980 Maier et al. ..... 227/9
4,930,673 A * 6/1990 Pfister ..... 227/10
5,829,661 A * 11/1998 Hirtl et al. ..... 227/10
6,378,752 B1 * 4/2002 Gaudron ..... 227/10
6,685,078 B1 * 2/2004 Wohlwend et al. ..... 227/120
6,722,549 B1 * 4/2004 Shkolnikov et al. ..... 227/10
6,761,299 B1 * 7/2004 Caringella et al. ..... 227/10
6,796,476 B1 * 9/2004 Birk et al. ..... 227/2
6,994,240 B1 * 2/2006 Jakob et al. ..... 227/8

* cited by examiner

*Primary Examiner*—Scott A. Smith
(74) *Attorney, Agent, or Firm*—Abelman, Frayne & Schwab

(57) ABSTRACT

A magazine for a hand-held setting tool for driving in fastening elements includes a guide housing (21), a spring-biased displacement element (24) for displacing fastening element (40), and an elongate guide member (26) having a guide region (27) that in a closing position (33) of the guide member (26) projects into the guide chamber (22), which is formed in the guide housing (21) for retaining the fastening elements in the guide channel (22), and that in a release position (34) of the guide member (26) is withdrawn from the guide chamber (22) to provide for displacement of at least one fastening element (40), with the guide member (26) having two support sections (28, 29) spaced from each other in a longitudinal direction of the guide member (26) and cooperating, respectively, with two control cams (30, 31) fixedly secured on the guide housing (21) for displacing the guide region (27) from the locking position (33) to the release position (34) and from release position (34) to the locking position.

11 Claims, 3 Drawing Sheets

MAGAZINE WITH FASTENING ELEMENTS FOR A SETTING TOOL AND A SETTING TOOL WITH THE MAGAZINE WITH FASTENING ELEMENTS

BACKGROUND OF THE INVENTION

1. Field of the Invention

The present invention relates to a magazine with fastening elements, such as nails, bolts, pins, for a hand-held setting tool for driving in fastening elements and including a guide housing having a guide chamber formed therein for receiving fastening elements and having at least one stop edge, the guide chamber opening at least to a connection region of the setting tool, a spring-biased displacement element for displacing the fastening elements, and an elongate guide member having a guide region that in a closing position of the guide member projects into the guide chamber and form-locklingly cooperates with the at least one stop edge for retaining the fastening elements in the guide channel, and that in a release position of the guide member is withdrawn from the guide chamber for disengagement from the stop edge to provide for displacement of at least one fastening element. The present invention also relates to a setting tool with the magazine of the type described above.

2. Description of the Prior Art

Setting tools of the type described above are used for driving in fastening elements such as nails, bolts, pins, etc., which are stored in a magazine, in concrete, steel, wood, and the like. The setting tools can be driven with liquid, gaseous, or solid fuels or by pneumatic, mechanical, or electropneumatic drives.

German Publication DE 19831060 discloses a setting tool with a nail magazine that projects sidewise from a guide tube. The nail magazine includes a guide rail with a guide channel for receiving fastening elements. On the guide rail, there is provided a locking element pivotally arranged and which has a guide region which projects, in the locking position, into the empty space of the guide channel, so that displacement of fastening elements, which are contained in the nail magazine, in a direction opposite the setting direction, is limited.

The drawback of the magazine, which is disclosed in DE 19831060 consists in the sensitivity of the locking element to cross-accelerations, which leads to an extensive wear at the pivot support location.

Accordingly, an object of the present invention is to improve the setting tool of the type described above so that the above-mentioned drawback is eliminated, and the reliability of functioning of the locking element is substantially increased.

SUMMARY OF THE INVENTION

This and other objects of the present invention, which will become apparent hereinafter, are achieved by providing a magazine for fastening elements for the setting tool and in which the guide member has two support sections spaced from each other in a longitudinal direction of the guide member and cooperating, respectively, with two control cams fixedly secured on the guide housing for displacing the guide region from the locking position to the release position and from the release position to the locking position.

The novel features of the present invention insure that the support for the guide member is not sensitive to cross-acceleration while insuring a reliable transition of the guide member from the release position into the locking position and from the locking position into the release position. The foregoing novel features of the present invention also insure essentially a complete abutment of the guide region of the guide member with the stop edge of the fastening element or the magazine strip.

Advantageously, the guide member is resiliently biased by at least one spring in a direction of its locking position. This prevents an unintended transition of the guide member from the locking position to a release position and insures a reliable retention of the guide member in the locking position.

Advantageously, the guide member is formed as a guide rail. This insures a slim geometry of the magazine and, in particular, of the magazine guide housing.

It is further advantageous when the guide member is displaced parallel to the guide space, when being displaced in a longitudinal direction. This insures displacement of the guide member with a displacement member or with a transporting spring when the displacement member or spring is displaced from its unloaded position to a loading position. At that, a simple temporary connection of the guide member with the displacement member is necessary.

It is further advantageous when the guide member is formed as a stamped bent workpiece of a sheet metal. This insures a cost-effective manufacturing of the guide member.

Advantageously, the magazine for fastening elements according to the present invention has a connection region for mounting the magazine on a bolt guide of a setting tool.

According to embodiment of the invention which can be produced particularly cost-effectively, the control cams are arranged directly on the guide housing, in particularly, are formed thereon. Advantageously, the control cams have inclinations or inclined surfaces for lifting the guide member off the locking position. The parallel arrangement of two control cams, with each having an inclined surface, insures lifting off the guide member from the locking position without tilting and parallel to the guide space of the guide channel. The inclinations or the inclined surfaces are preferably so formed that they have substantially the same inclination angle, length and are spaced from the guide space by substantially the same distance.

It is advantageous from the manufacturing point of view when the guide housing is formed as a plastic shaped part.

The present invention is particularly advantageous when the magazine with fastening elements is arranged in the region of the receptacle of the setting tool. The receptacle for the fastening elements is advantageously provided in the bold guide of the setting tool, and the magazine in pinned on the bolt guide with its connection region.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENT

Figure 1:
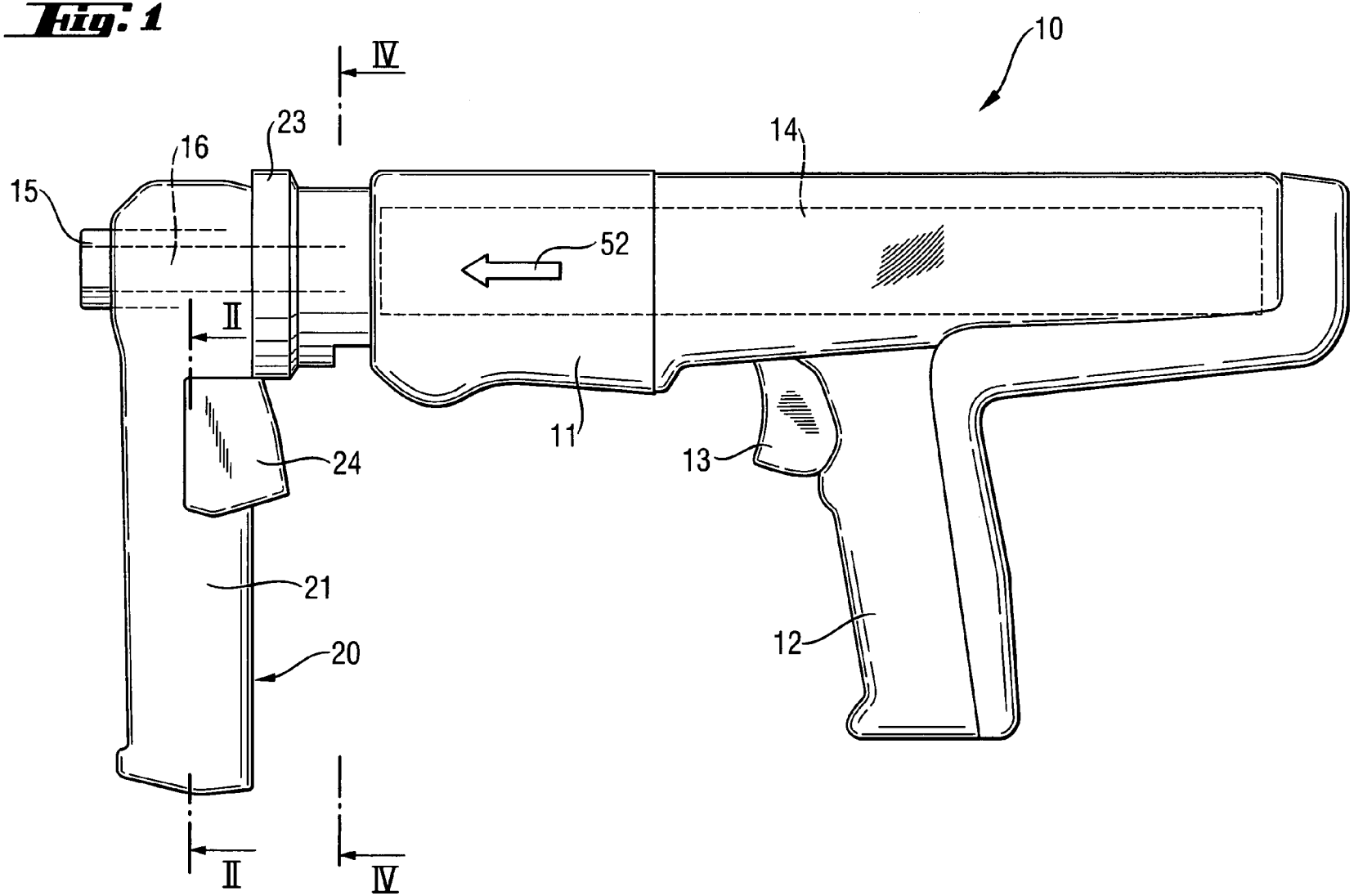
FIG. 1 a side view of a setting tool according to the present invention with a magazine for fastening elements.

FIG. 1 shows a magazine 20 for fastening elements according to the present invention and which is attached to a setting tool 10. The setting tool 10 has a housing 11 with a handle 12 formed thereon. On the handle 12, there is provided a switch 13 for actuating a setting process. The setting tool 10 further includes a setting mechanism 14 which is not shown and described here and different embodiments of which are well known to ones skilled in the art. A bolt guide 15 adjoins the setting mechanism 14 in a setting direction 52. The bolt guide 15 has a receptacle 16 for to-be-set fastening elements 40 (see in particular FIG. 4). The magazine 20 has a ring-shaped connection region 23 that seats on the bolt guide 15 of the setting tool 10. It is also possible to so form the magazine for fastening elements that the bolt guide forms part of the magazine, with the magazine unit begin secured to the setting tool with a special coupling or by a threaded connection.

The construction of the magazine 20 for fastening elements will now be explained in detail with reference to FIGS. 2 through 4. The magazine 20 has a guide housing 21 with a channel-shaped guide chamber 22. The guide chamber 22 opens toward the receptacle 16 of the bolt guide 15 or toward connection region 23, on one hand, and toward the setting tool 10, i.e., in a direction opposite the setting direction, on the other hand. The opening toward the setting tool 10 is slot shaped.

Figure 3:
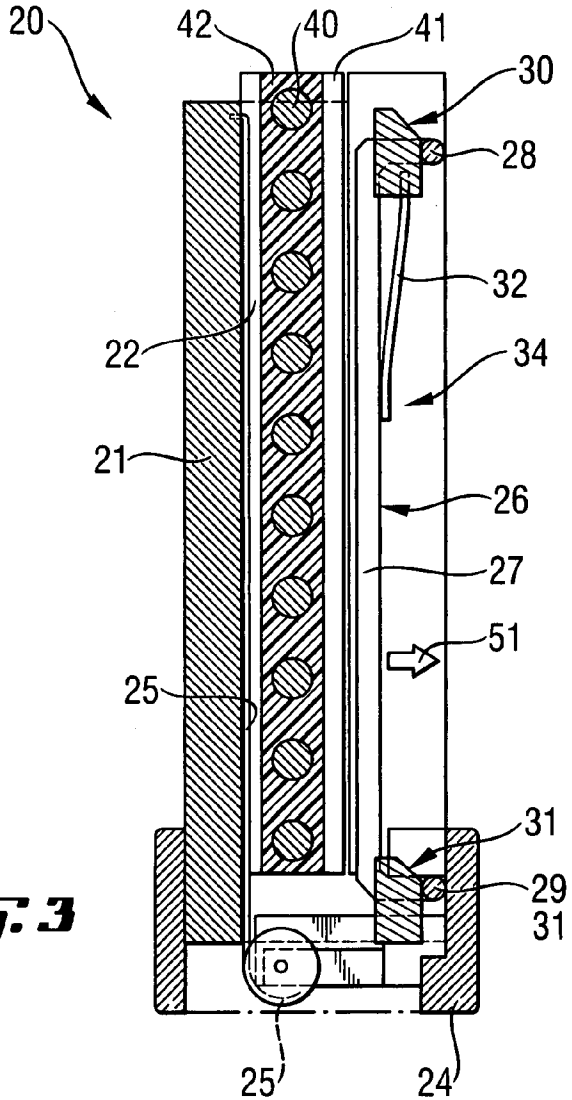
FIG. 3 a cross-sectional view similar to that of FIG. 2 but with the magazine in a release position.
Figure 2:
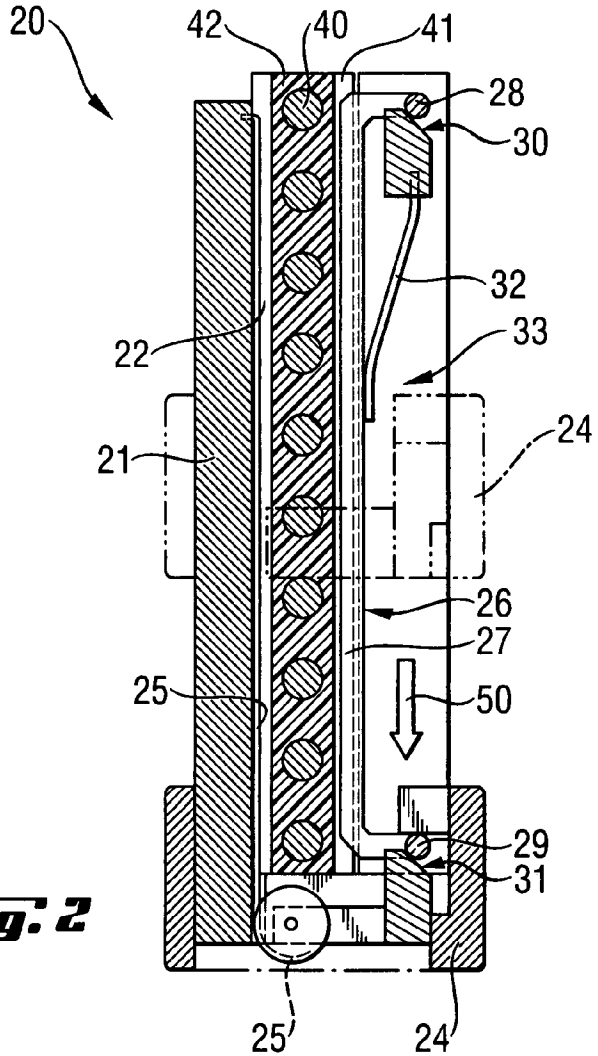
FIG. 2 a cross-sectional view along line II—II in FIG. 1 with the magazine in a locking position.
Figure 4:
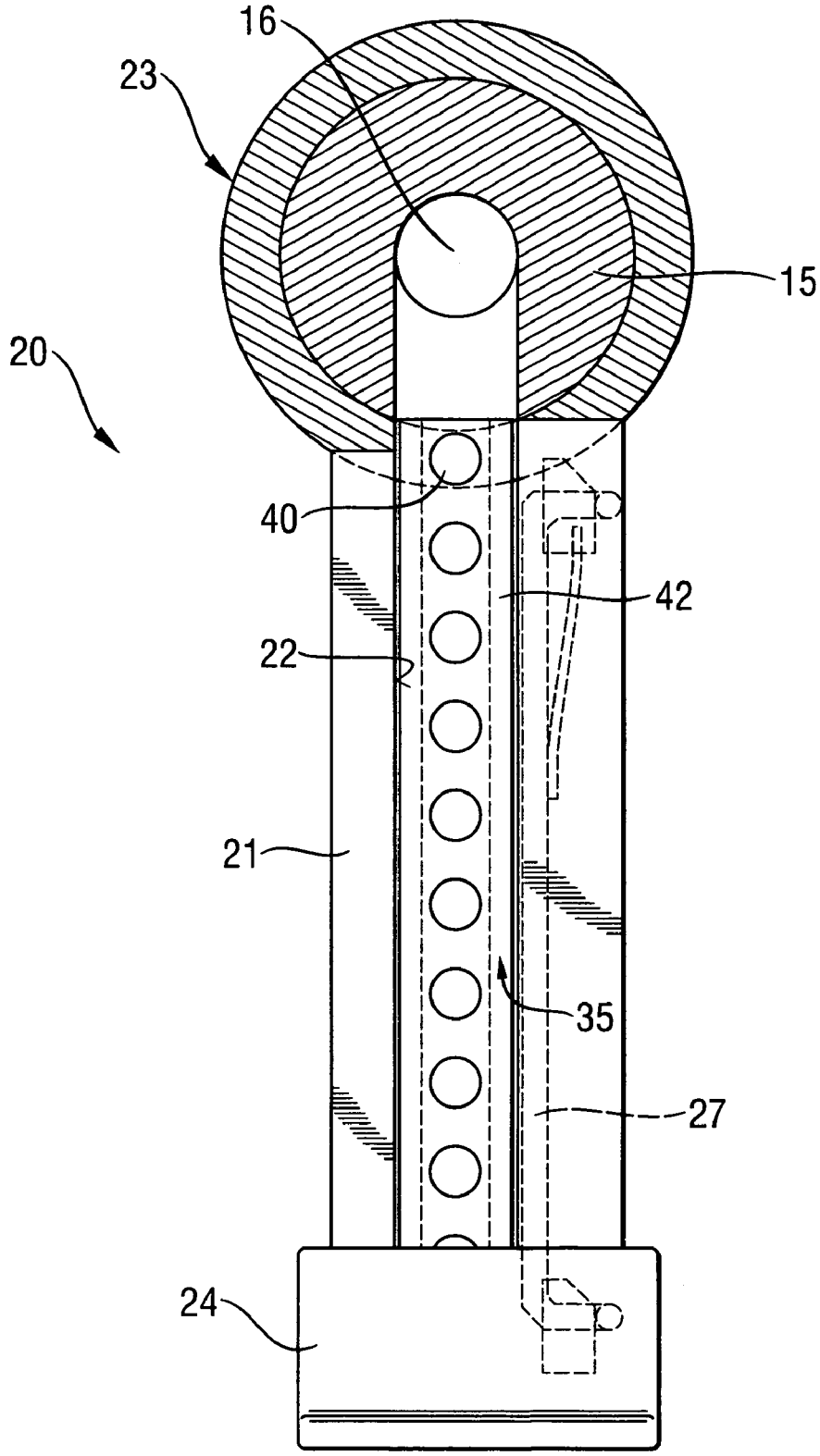
FIG. 4 a cross-sectional view along line IV—IV in FIG. 1 with the magazine in a release position.

As shown in FIGS. 2–4, a magazine strip 42 with fastening elements 40 is located in the guide chamber 22. The magazine strip 42 is preloaded in a transporting direction toward the receptacle 16 by a displacement element 24 which is biased by a transporting spring 25 formed as a scroll spring.

The magazine strip 42 has a stop edge 41 that, as shown in FIG. 2, lies behind a guide region 27 of a guide member 26 which is formed as a guide rail. The magazine strip 42 cannot be displaced out of the guide chamber 22 of the magazine 20 in the locking position 33 of the guide member 26 in which the guide region 27 of the guide member 26 projects into the guide chamber 22. In the locking position 33, the magazine strip 42 is guided in the guide chamber 22 without tilling.

The guide member 26 is supported in the guide housing 21 for displacement along its longitudinal axis. At its opposite ends, the guide member 26 has support sections 28, 29 guided over control cams 30, 31 which are formed on the guide housing 21. The guide member 26 is resiliently biased toward its locking position 33 by a spring 32, with the support sections 28, 29 being pressed against the control cams 30, 31.

In FIG. 2, the displacement element 24, which is formed as a transporting slide, is shown with dot-dash lines in a transporting position in which the transporting spring 25 is loaded, and is shown with solid lines in its second position in which the displacement element 24 abuts the support section 29 of the guide member 26. The displacement element 24 is displaced manually in a direction of the arrow 50.

For lifting the guide region 27 of the guide member 26 off the guide chamber 22, the displacement element 24 should be displaced further in the direction of the arrow 50. Upon further displacement, the displacement element 24 would entrain the support sections 28, 29, displacing them along inclined surfaces of the control cams 30, 31 until the support sections 28, 29 lie on straight surfaces, as shown in FIG. 3. As a result, the guide region 27 of the guide member 26 is lifted off the guide chamber 22 in direction of arrow 51 and occupies its release position 34. In the release position 34 of the guide member 26, the magazine strip 42 can be displaced out of the magazine 20 through rear opening 35 of the guide housing 21 and/or a new magazine strip 42 can be introduced in the magazine 20.

Though the present invention was shown and described with references to the preferred embodiment, such is merely illustrative of the present invention and are not to be construed as a limitation thereof and various modifications of the present invention will be apparent to those skilled in the art. It is therefor not intended that the present invention be limited to the disclosed embodiment or details thereof, and the present invention includes all variations and/or alternative embodiments within the spirit and scope of the present invention as defined by the appended claims.

What is claimed is:

1. A magazine with fastening elements for a hand-held setting tool for driving in fastening elements, comprising:

a guide housing (21) having a guide chamber (22) formed therein for receiving fastening elements (40) and having at least one stop edge (41), the guide chamber (22) opening at least to a connection region (16) of the setting tool (10);

a spring-biased displacement element (24) for displacing the fastening elements (40); and an elongate guide member (26) having a guide region (27) that in a closing position (33) of the guide member (26) projects into the guide chamber (22) and formlockingly cooperates with the at least one stop edge (41) for retaining the fastening elements in the guide channel (22), and that in a release position (34) of the guide member (26) is withdrawn from the guide chamber (22) for disengagement from the stop edge to provide for displacement of at least one fastening element (40), the guide member (26) further having two support sections (28, 29) spaced from each other in a longitudinal direction of the guide member (26) and cooperating, respectively, with two control cams (30, 31) fixedly secured on the guide housing (21) for displacing the guide region (27) from the locking position (33) to the release position (34) and from release position (34) to the locking position.

2. A magazine according to claim 1, further comprising at least one spring member (32) for biasing the guide member (26) in a direction of the locking position thereof.

3. A magazine according to claim 1, wherein the guide member (26) is formed as an elongate guide rail.

4. A magazine according to claim 1, wherein the guide member (26) is displaceable in the longitudinal direction thereof parallel to the guide chamber (22).

5. A magazine according to claim 1, wherein the guide member (26) is formed of sheet metal as a bent stamped part.

6. A magazine according to claim 1, having a connection region (23) for securing the magazine (20) on a bolt guide of the setting tool (10).

7. A magazine according to claim 1, wherein the control cams (30, 31) are provided on the guide magazine (21) and each has an inclination.

8. A magazine according to claim 7, wherein the inclinations of both control cams (30, 31) have substantially identical inclination angles, length, and are spaced from the guide chamber (22) by substantially same distance.

9. A magazine according to claim 1, wherein the guide housing (21) is formed as a plastic shaped part.

10. A setting tool for driving fastening elements in a constructional component, comprising a housing (11); a setting mechanism (14) located in the housing for driving in fastening elements; a receptacle (16) for receiving fastening elements (40); and a magazine (20) with fastening elements (40) arrange in a region of the receptacle (16) and including:

a guide housing (21) having a guide chamber (22) formed therein for receiving fastening elements (40) and having at least one stop edge (41), the guide chamber (22) opening at least to a connection region (16) of the setting tool (10);

a spring-biased displacement element (24) for displacing the fastening elements (40); and an elongate guide member (26) having a guide region (27) that in a closing position (33) of the guide member (26) projects into the guide chamber (22) and form-lockingly cooperates with the at least one stop edge (41) for retaining the fastening elements in the guide channel (22), and that in a release position (34) of the guide member (26) is withdrawn from the guide chamber (22) for disengagement from the stop edge to provide for displacement of at least one fastening element (40), the guide member (26) further having two support sections (28, 29) spaced from each other in a longitudinal direction of the guide member (26) and cooperating, respectively, with two control cams (30, 31) fixedly secured on the guide housing (21) for displacing the guide region (27) from the locking position (33) to the release position (34) and from release position (34) to the locking position.

11. A setting tool according to claim 10, wherein the receiving region (16) is arranged in a bolt guide (15) of the setting tool (10), and the magazine (20) is pinned with a connection region (23) thereof on the bolt guide (15).

* * * * *